US007104033B2

(12) United States Patent
Krulitsch

(10) Patent No.: US 7,104,033 B2
(45) Date of Patent: Sep. 12, 2006

(54) BEVERAGE BOTTLING PLANT FOR FILLING BOTTLES WITH A LIQUID BEVERAGE, HAVING A FILLING ELEMENT AND FILLING MACHINE WITH SUCH FILLING ELEMENTS

(75) Inventor: Dieter-Rudolf Krulitsch, Bad Kreuznach (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 54 days.

(21) Appl. No.: 11/016,363

(22) Filed: Dec. 17, 2004

(65) Prior Publication Data

US 2005/0172580 A1 Aug. 11, 2005

(30) Foreign Application Priority Data

Dec. 19, 2003 (DE) ..... 103 59 779

(51) Int. Cl.
*B65B 3/04* (2006.01)

(52) U.S. Cl. ..... 53/467; 53/415; 53/420; 53/426; 53/167; 53/276; 141/91

(58) Field of Classification Search ..... 53/167, 53/135.1, 272, 276, 371, 396, 415, 420, 425, 53/426, 467; 141/89, 90, 91
See application file for complete search history.

(56) References Cited

U.S. PATENT DOCUMENTS 4,254,804 A * 3/1981 Wada et al. ..... 141/40
4,342,344 A * 8/1982 Ahlers ..... 141/39
4,572,252 A * 2/1986 Ponzi et al. ..... 141/90
4,967,813 A * 11/1990 Ponvianne et al. ..... 141/91
5,016,684 A * 5/1991 Clusserath ..... 141/6
5,060,449 A * 10/1991 Klarl ..... 53/88
5,598,876 A * 2/1997 Zanini et al. ..... 141/90
5,819,817 A * 10/1998 Van Nest ..... 141/91
5,826,748 A * 10/1998 Qian et al. ..... 222/1
6,038,833 A * 3/2000 Beringer ..... 53/272
6,192,946 B1 * 2/2001 Clusserath ..... 141/40
6,457,495 B1 * 10/2002 Meheen ..... 141/40
6,463,964 B1 * 10/2002 Clusserath ..... 141/40
6,470,922 B1 * 10/2002 Sindermann ..... 141/63
6,474,368 B1 * 11/2002 Clusserath et al. ..... 141/6
6,530,401 B1 * 3/2003 Angehrn et al. ..... 141/64
6,918,417 B1 * 7/2005 Bernhard ..... 141/89

FOREIGN PATENT DOCUMENTS

DE 37 22 495 A1 1/1989
DE 94 03 832 U1 4/1995
EP 0 574 321 A 12/1993
EP 0 659 682 A 6/1995

* cited by examiner

*Primary Examiner*—Louis Huynh
(74) *Attorney, Agent, or Firm*—Nils H. Ljungman & Associates

(57) ABSTRACT

A beverage bottling plant for filling bottles with a liquid beverage, having a filling element of a filling machine with a rotary construction for filling bottles or similar containers with a liquid has, in a filling element housing, a liquid duct for the controlled dispensing of a liquid at a dispensing opening. The dispensing opening is located in a recess into which the respective container extends with its container mouth during the filling, and into which at least one additional duct of the filling element empties. During a cleaning or rinsing phase, the recess can be closed by a plate-shaped closing element.

19 Claims, 13 Drawing Sheets

BEVERAGE BOTTLING PLANT FOR FILLING BOTTLES WITH A LIQUID BEVERAGE, HAVING A FILLING ELEMENT AND FILLING MACHINE WITH SUCH FILLING ELEMENTS

BACKGROUND

1. Technical Field

The present application relates to a beverage bottling plant for filling bottles with a liquid beverage, having a filling element as described herein below and a filling machine as described herein below.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The prior art describes a wide variety of filling elements, in particular those used on filling machines that employ a rotary design. The prior art also discloses that these filling elements and the surfaces of the filling elements that come into contact with critical areas of the containers during the filling can be cleaned and/or rinsed in a cleaning or rinsing phase with a liquid or vapor-phase medium, for example. Critical areas of the containers include but are not limited to the interior surfaces of the containers and the surfaces in the vicinity of the mouths of the containers.

For cleaning and/or rinsing, it is customary to attach cap-like closing elements, for example on the filling elements in the vicinity of the dispensing openings through which, during the filling process, the liquid being bottled is introduced into the containers, specifically to form closed rinsing spaces. The filling elements, including their ducts and areas that come into contact with critical areas of the container, can then be rinsed and cleaned by means of the rinsing and cleaning medium, for example, which flows into the rinsing space or via the respective dispensing opening of the liquid duct and is removed via at least one additional duct that also empties into the rinsing space, for example via the return gas duct.

OBJECT OR OBJECTS

The installation and fixing of the cap-like closing elements as part of the preparation for the rinsing or cleaning phase and the removal of said closing elements after the rinsing and cleaning phase has been completed are complex and time-consuming operations. The object is therefore to describe a filling element that eliminates these disadvantages, which can be cleaned/rinsed in a simplified manner.

SUMMARY

On the filling element claimed by the present application, the closing element located or held in a receptacle of the container carrier can be pressed by the container carrier against a sealing surface to form the respective closed rinsing space, which sealing surface can surround the opening of a recess on the underside of the filling element, in which the dispensing opening can be provided and into which the containers may extend with their container mouth for filling.

The container carrier can be realized so that it holds the containers from behind, in the manner of a fork, for example, on a container flange that may be formed slightly below the mouth of the container.

The closing elements may be realized in the form of a plate, at least on the portion of their surface which, when the rinsing space is closed, can be pressed against the sealing surface of the filling element.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described in the subclaims. The embodiments are explained in greater detail below with reference to the exemplary embodiments illustrated in the accompanying figures, in which:

DESCRIPTION OF EMBODIMENT OR EMBODIMENTS

Figure 1:
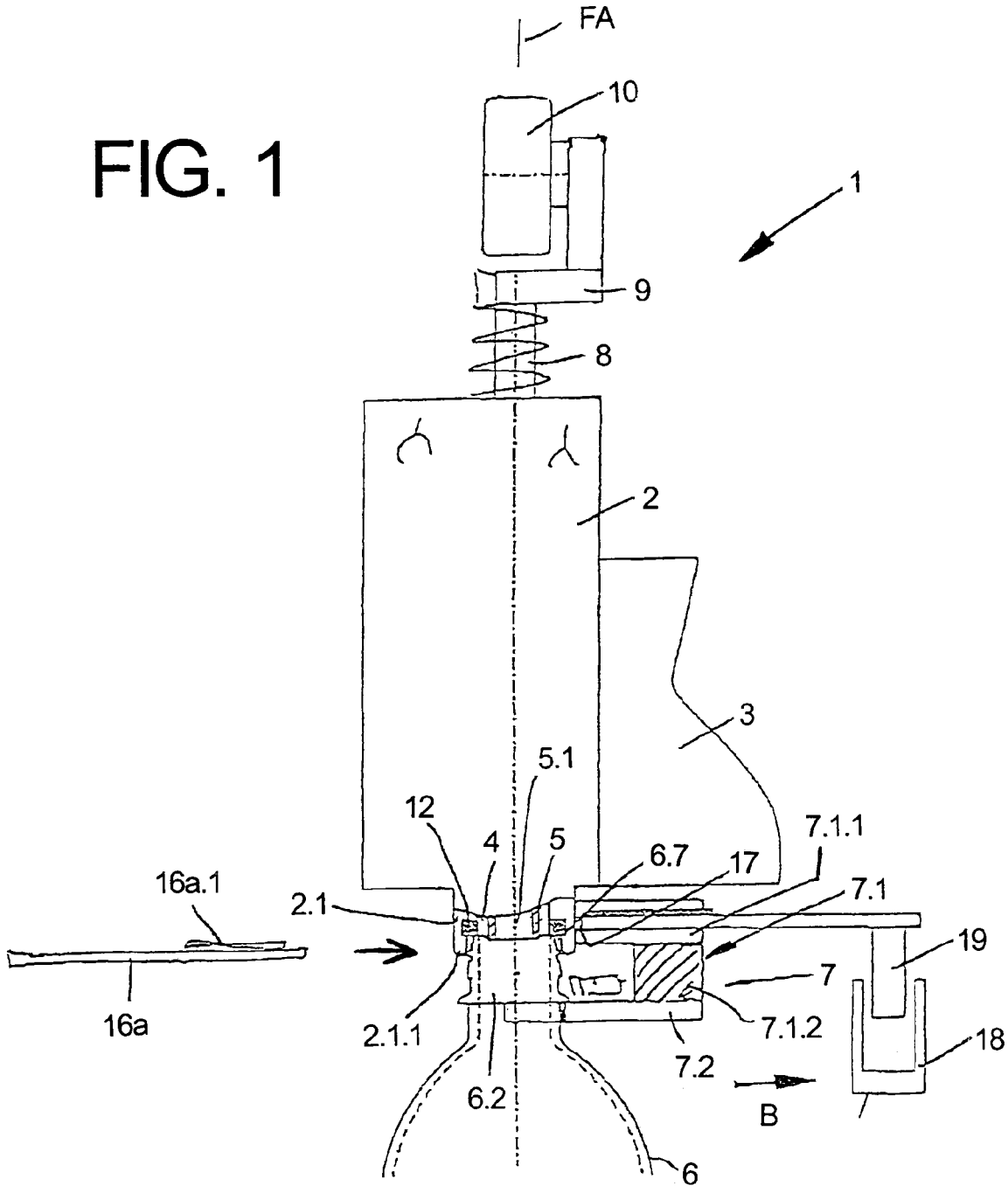
FIG. 1 is a simplified illustration of a filling element of a filling machine with a rotary construction for filling containers in the form of PET bottles with a liquid (beverage), together with a container that is located in the sealing position on the filling element.
Figure 1A:
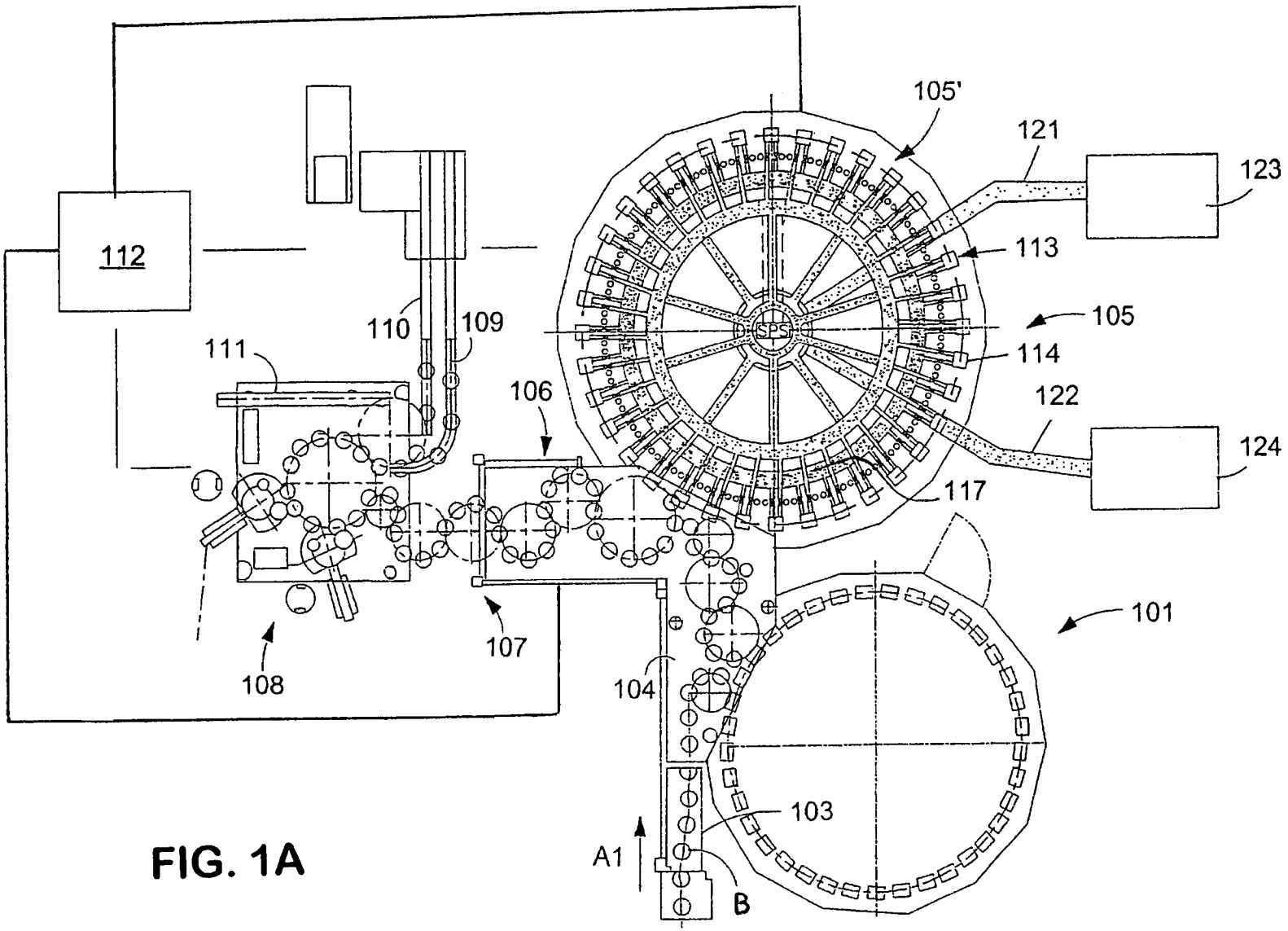
FIG. 1A is a schematic illustration of a container filling plant according to at least one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 1B:
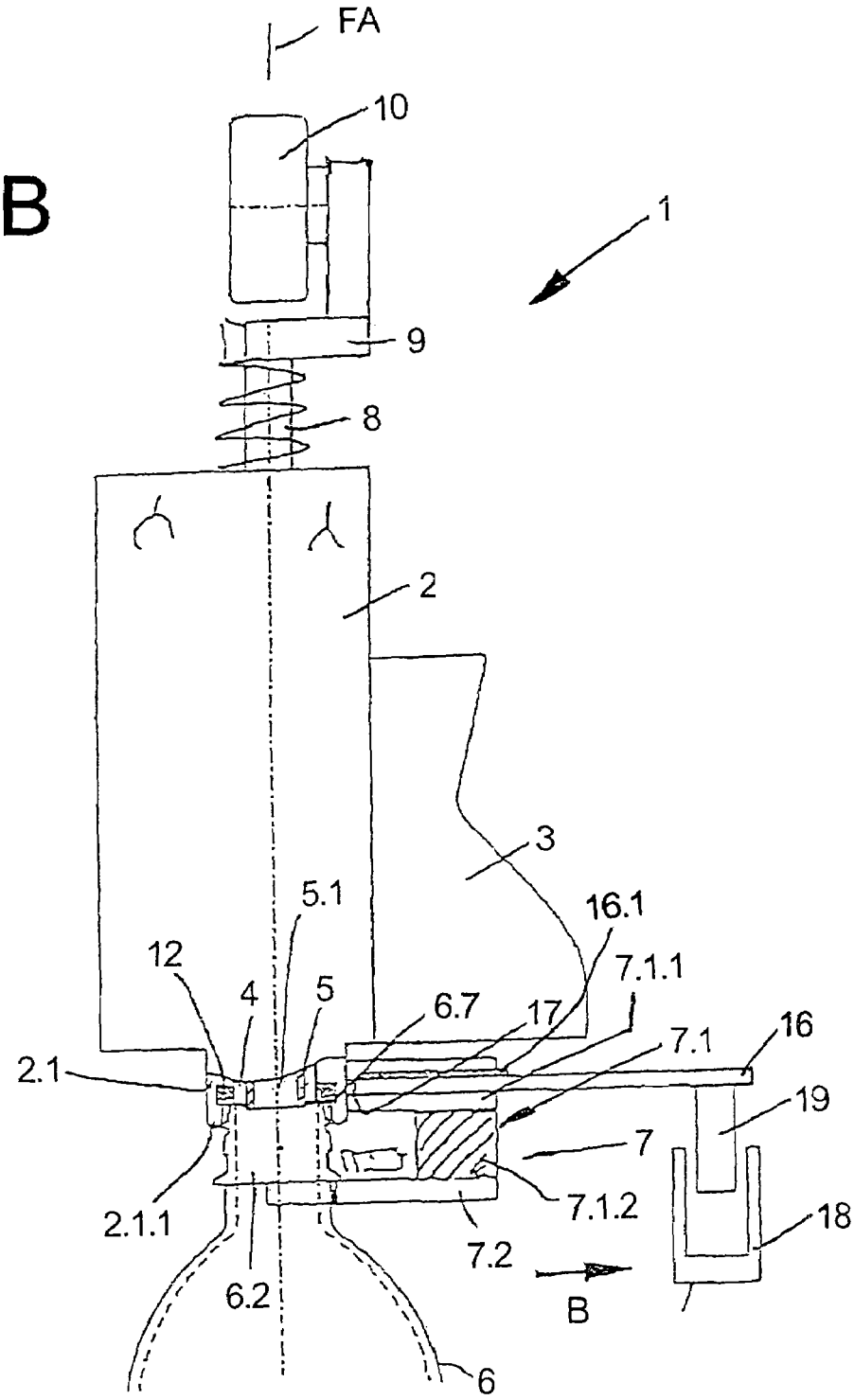
FIG. 1B is a simplified illustration of a filling element together with an automatic closing element.
Figure 1C:
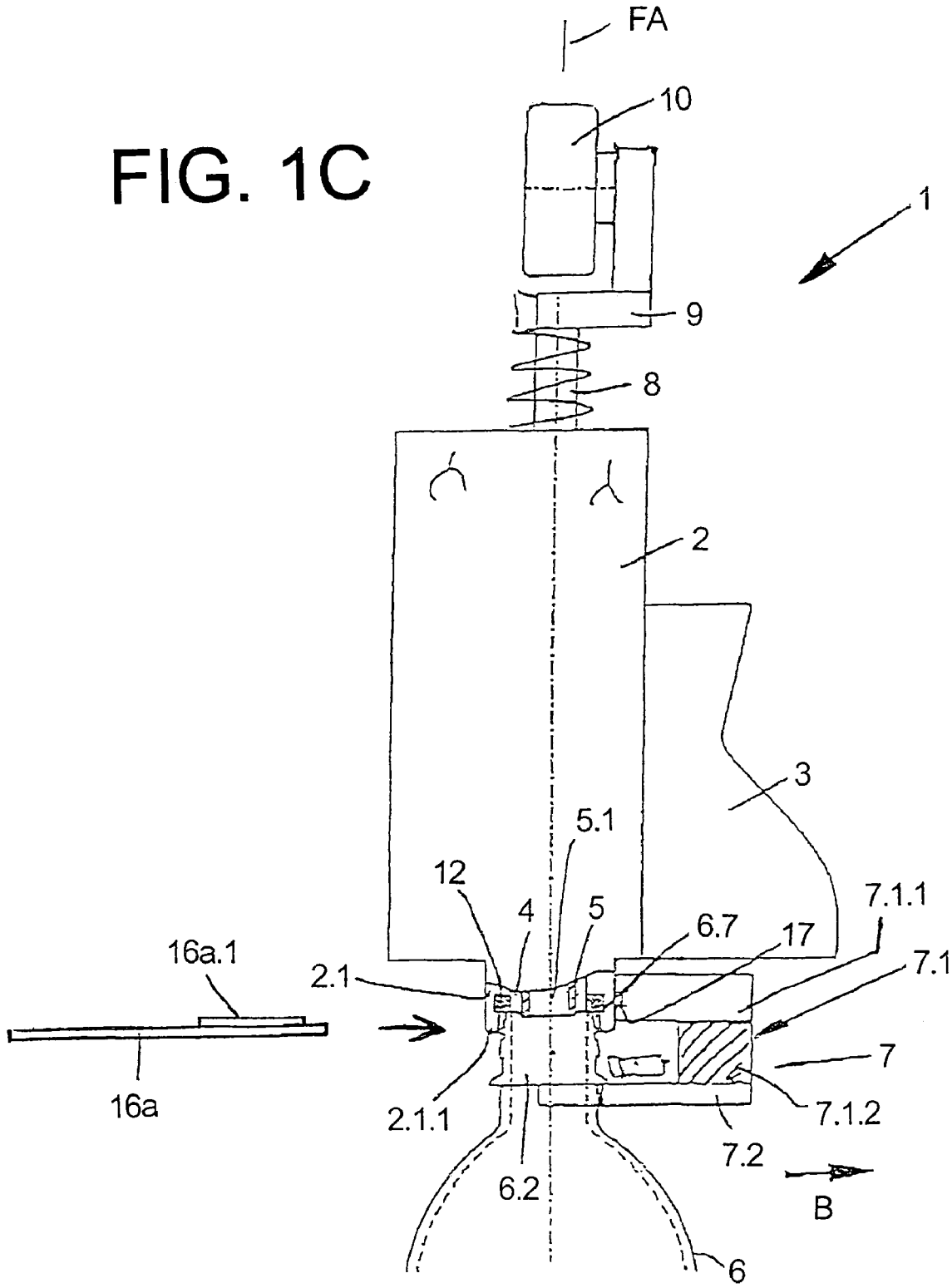
FIG. 1C is a simplified illustration of a filling element together with a manually-insertable closing element.

It should be understood that FIG. 1 shows two possible embodiments of a closing element in a filling element 1, both of which are discussed in greater detail below and shown individually in FIGS. 1B and 1C. To explain briefly, on the left side of FIG. 1 is shown a manually-insertable closing element 16*a*. On the right side of FIG. 1, located opposite the left side, is another closing element 16 (not numbered in FIG. 1), which is automated and driven by a driver dog or projection 19 in a driver 18. In one possible embodiment, the filling element 1 could be designed to utilize both closing elements 16, 16*a*. For example, in the event that the automated system using the closing element 16 were damaged or malfunctioning or not operating properly, the filling element 1 could be designed to utilize the closing element 16*a* until the automated system was repaired or replaced.

In the figures, there is the filling element 1, which in the illustrated embodiment is realized in the form of a filling element without a filling pipe, and with its filling element housing 2 can be driven in rotation around a vertical machine axis of a filling machine together with a plurality of identical filling elements on the circumference of a rotor 3, whereby the filling machine is otherwise not shown in any particular detail in FIG. 1. In the housing 2, in a manner which is described by the prior art, there are, among other things, a liquid duct with a liquid valve for the controlled dispensing of the liquid being bottled as well as at least one controllable gas path, whereby the liquid channel is in communication with a reservoir or duct realized on the rotor for the feed of the liquid being bottled, and the at least one controllable gas path is in communication with at least one gas duct provided in the rotor, all of which is basically familiar to a technician skilled in the art.

On the underside of the housing 2, the controllable liquid duct that can be controlled by the liquid valve (not shown) forms a ring-shaped dispensing opening 4 for the liquid to be bottled. The dispensing opening 4 surrounds a return gas pipe 5, which with its axis defines the vertical filling element axis FA and forms a return gas duct 5.1 which is open on its lower end. Above this return gas duct, for example when the container 6 illustrated in FIG. 1 is in sealed contact with the filling element 1 under backpressure, the inert gas ($CO_2$ gas) that is displaced by the liquid being bottled as it flows out of the reservoir is removed, a process that will also be familiar to a technician skilled in the art. The return gas pipe 5 and the duct 5.1 can also perform other functions, for example for the rinsing and or pressurization of the interior of the container with inert gas etc.

One component of the filling element 1 is also a container carrier 7 on the underside of the housing 2. This container carrier 7 is fastened on the lower end of two guide rods 8 that are oriented parallel to the filling element axis FA, and are displaced in the housing 2 or in guides formed there so that they can be moved by a specified axial distance, and are offset from each other in the direction of rotation of the rotor 3. On the upper end, the two guide rods 8 are connected with each other on the end of a yoke 9, which is oriented radially with its longitudinal dimension with respect to the filling element axis FA, and on which a control roller 10 is mounted so that it can rotate freely, and at least during normal filling operation interacts with at least one stationary control cam 11 so that when the rotor 3 rotates, each container carrier 7 is lowered in the vicinity of a container inlet of the filling machine, to which the empty containers 6 are fed individually in a filling position formed by a filling element 1, and to a container outlet, at which the filled containers 6 are removed from the respective filling position. While in the corner area or angular range of the rotational movement of the rotor 3, following the container inlet and before reaching the container outlet, the container carriers 7 are raised so that the respective container 6 held on a container carrier 7 is pressed with its container mouth 6.1 against an O-ring 12 that encircles the dispensing opening 4 in a manner that creates a sealed contact. By means of two compression springs 13, each of which surrounds a guide rod 8 and acts between the upper side of the housing 2 and the yoke 9, each container carrier 7 is pushed into its raised position, and is moved into the lower position by the control roller 10 that interacts with the control cam 11 on the container inlet and container outlet and in the corner area of the rotational movement of the rotor 3 between the container outlet and container inlet against the action of the compression springs 13.

In an additional known configuration, the pressure applied to the of the container carriers 7 is not effected by compression springs 13, but by means that are located inside the filling element 1, such as, for example, pneumatic cylinders and/or rubber seal membranes, whereby it is particularly advantageous if said means are pressured by inert gas under the bias or filling pressure.

The container carrier 7 comprises, among other things, a carrier element 7.1 which is realized in one piece with two webs 7.1.1 and a wall-shaped or leg-shaped section 7.1.2. The webs 7.1.1 are oriented with their longitudinal dimension oriented radially or approximately radially with respect to the vertical machine axis and are each connected on their outboard ends—with reference to the machine axis—with the lower end of one of the two guide rods 8. On their inboard ends, the webs 7.1.1 transition into the segment 7.1.2, which connects the two webs with each other on this end, and projects downward toward the filling element axis FA beyond the underside of the web 7.1.1 that faces away from the housing 2. The section 7.1.2 also lies with its surface sides in planes that are parallel to the filling element axis FA and parallel to a tangent to an imaginary circular orbit on which the filling elements 1 and their axes FA move when the filling machine is rotating.

Fastened to the underside of the section 7.1.2 is a fork-like carrier plate 7.2 of the container carrier 7. This carrier plate 7.2, which is oriented with its surface sides in planes that are perpendicular to the filling element axis FA, extends from the section 7.1.2, which is at some distance from the filling element axis FA, radially outward with respect to the vertical machine axis to the vicinity of the filling element axis FA and forms, on the radially outboard side with respect to the machine axis, a recess 14 which is open on said side. With this fork-like structure, the carrier plate 7.2 grasps from behind the respective container 6 that is held by the filling element 1 by means of a carrier or container flange 6.2 that is realized below the container mouth 6.1, so that said container 6 is suspended on its container flange 6.2. on the container carrier 7 and is pressed by the container carrier 7 with the container mouth 6.1 in the sealed position against the O-ring 12.

As the figures show, the dispensing opening 4, the lower end of the return gas pipe 5 and the O-ring 12 are provided inside a recess 15, which is formed in an extension 2.1 that projects beyond the underside of the housing 2, and is open on its lower end that faces away from the housing 2. The container 6 which is in sealed contact with the filling element 1 extends with its end that has the container mouth 6.1 into the recess 14, which thereby also serves to center the container 6 on the filling element 1. As shown in FIG. 1, when the container 6 is in the sealed position with the filling element 1, the housing projection 2.1 is surrounded in a fork-like manner by the two webs 7.1.1 that are at some distance from each other and come one after the other in the direction of rotation of the rotor 3, i.e. the housing projection 2.1 projects through the opening formed between the webs 7.1.1 beyond the underside of the webs 7.1.1 farther from the housing 2.

From time to time, it is necessary to clean or rinse the filling machine, including its filling elements 1, and in particular the liquid and/or gas paths that are realized in these filling elements 1, including the return gas duct 5.1. During this cleaning and/or rinsing (also termed CIP cleaning), not only are the various liquid and/or gas paths of all the filling elements 1 of the filling machine flushed by the cleaning and/or rinsing media, but it is also necessary to clean all of the surfaces of the respective filling element 1 that come into contact with the surface of the container, in particular in the vicinity of the container mouth 6.1, and also thereby especially clean the O-ring, the inside surfaces of the recess 15 and the return gas pipe 5.

For the cleaning, the housing projection 2.1 of each filling element 1 is tightly closed on its lower, open end by a rinsing plate 16 which is rectangular in the illustrated embodiment, whereby associated with each filling element 1 is its own rinsing plate 16, which is then oriented with its surface sides in planes that are perpendicular to the filling element axis FA. The rinsing plate 16, which is fabricated from metal or a suitable plastic, for example, is guided with its two long sides that extend approximately radially in relation to the machine element on the carrier element 7.1 or on the facing long sides of the webs 7.1.1. For this purpose, the webs 7.1.1 have, on each of these long sides, a guide groove 17, in each of which one long edge of the rinsing plate 16 is engaged.

Figure 2:
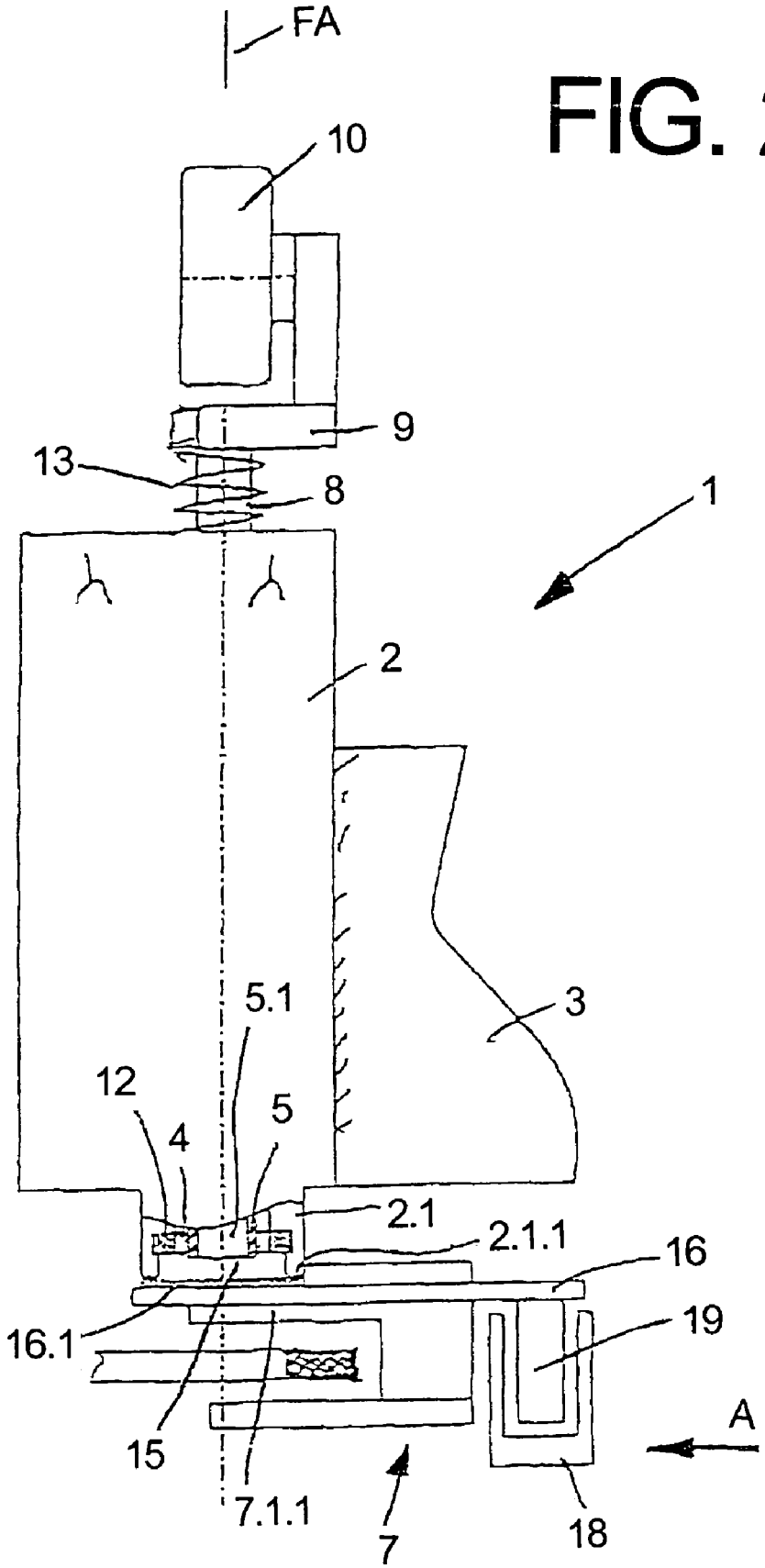
FIG. 2 is an illustration of the filling element illustrated in FIG. 1, but with a filling element closed for a cleaning (CIP—Cleaning In Place method) by a closing element in the form of a rinsing plate.
Figure 3:
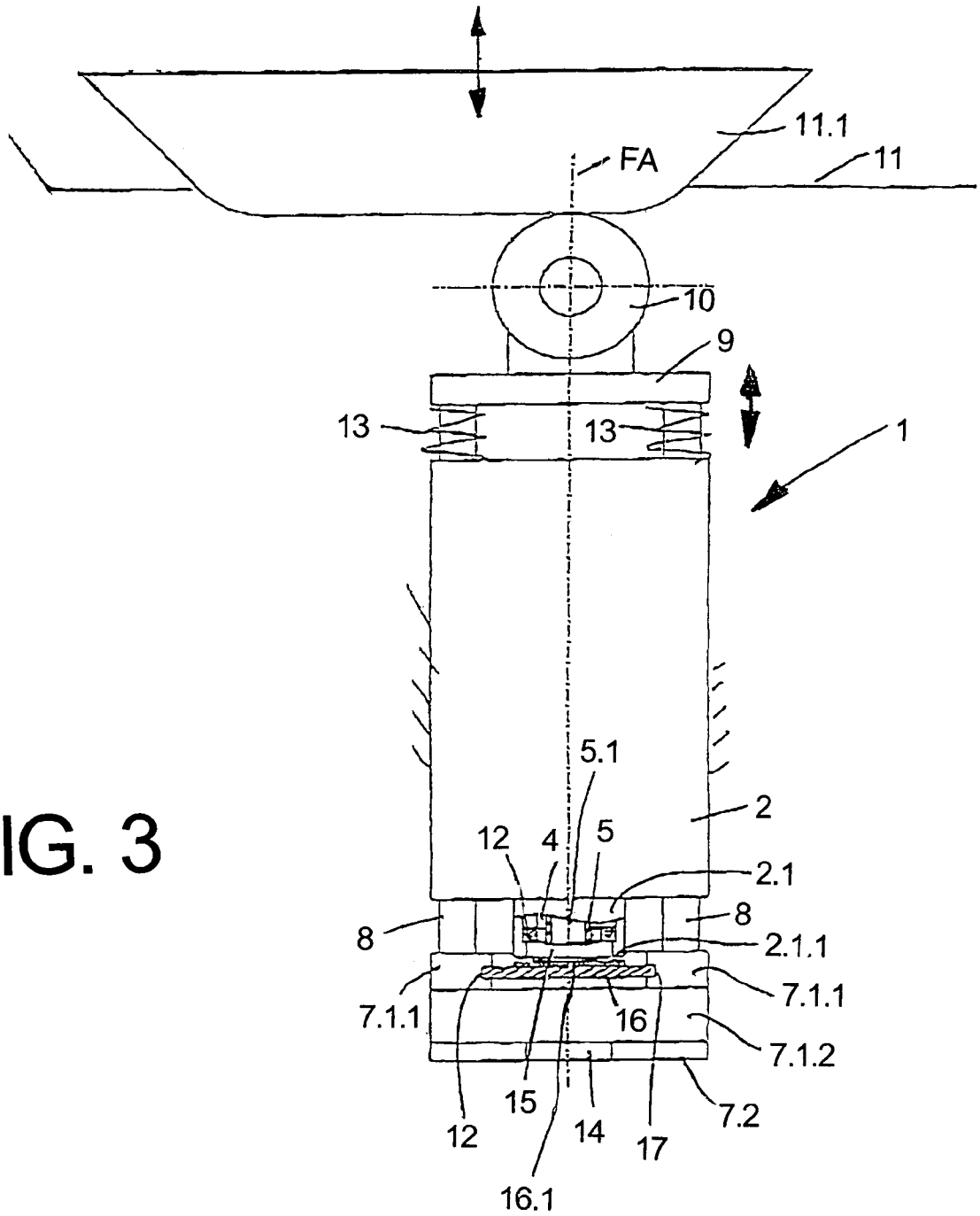
FIG. 3 the filling element in a view radial to a vertical machine axis.

In this guide, the rinsing plate 16 can be moved radially with respect to the machine axis from an idle or initial position, in which the rinsing plate 16 is located during normal filling operation of the filling machine and which is illustrated in FIG. 1, radially outward (Arrow A in FIG. 2) into a rinsing position which is illustrated in FIG. 2 and in which the rinsing plate 16 with a seal 16.1 provided on its upper side is directly below the open end of the recess 15, so that the rinsing plate 16 can then be brought into the sealed position against the lower edge of the housing projection 2.1 that surrounds the opening of the recess 15 by raising the container carrier 7 with its seal 16.1. The recess 15 thereby forms a closed rinsing space, which can then be flushed by the respective cleaning or rinsing medium to clean and/or rinse all the liquid and gas paths and all critical surfaces. The cleaning or rinsing medium flows to the rinsing space, for example, via the gas duct 5.1 and is removed via the dispensing opening 4. A reverse direction of flow and/or a change of the flow direction during the cleaning or rinsing phase are also possible.

To prepare for the cleaning or rinsing phase, each rinsing plate 16, with the container carrier 7 lowered, is moved radially outward from its initial position into the rinsing position, so that the seal 16.1 is located directly below the housing projection 2.1. By raising the container carrier 7, the rinsing plate 16 with its seal 16.1 is brought into the sealed position against the edge 2.1.1. After the completion of the cleaning or rinsing phase and after the lowering of the container carrier 7, the respective rinsing plate 16 is moved radially inward out of the rinsing position into the initial position. The cleaning or rinsing of the filling elements 1 is done while the machine is in rotation.

To further explain, when the carrier 7 is moved downward by the engagement of the roller 10 with the cam 11, the rinsing plate 16 is also moved downward from the position shown in FIGS. 1 and 1B to a position below the edge of the housing projection 2.1.1 at the bottom of the housing 2. At this point, the rinsing plate 16 can be moved radially to a position directly below the housing projection 2.1, such that the seal 16.1 is centered with the housing projection 2.1. As the filling element 1 is moved by the rotational movement of a carousel on which the filling element 1 is located, the roller 10 moves out of engagement with the cam 11. As a result, the guide rods 8 under the force of the compression springs 13 move upward and thus move the container carrier 7 upward. The upward movement of the container carrier 7 brings the seal 16.1 into a sealing engagement with the edge of the housing projection 2.1.1. Cleaning material is then run through the filling element 1, as discussed herein. Once the cleaning process is completed, the carrier 7 can be moved downward again by the engagement of the roller 10 and the cam 11, and the rinsing plate 16 can be moved radially back out from under the housing projection 2.1. The rinsing plate 16 is then moved back to its inactive position adjacent the housing projection 2.1, as shown in FIGS. 1 and 1B.

The seal 16.1 is held under pressure by at least the force of the compression springs 13 to promote a secure seal and to essentially prevent or restrict leakage of cleaning material during the cleaning process. Additional pressure force could be exerted on the seal 16.1 by additional apparatus located inside the housing 2 of the filling element 1 as discussed herein below in accordance with at least one possible embodiment.

In the illustrated embodiment, the movement of the rinsing plates 16 of all the filling elements 1 of the filling machine out of the initial position into the rinsing position (Arrow A) or out of the rinsing position into the initial position (Arrow B in FIG. 1) is done automatically by means of an actuator drive, of which the figures show only a guide or a driver 18 which is formed by a U-shaped profile. For example, a driver 18 of this type is associated with each filling element 1, whereby the driver can be moved radially on the rotor 3 in relation to the machine axis or on an element of said rotor, and associated with each filling element 1 there is also an actuator element, such as a pneumatic cylinder, for example, for the radial movement. Other configurations are also conceivable, such as a mechanical coupling of a plurality of drivers 18 with a common actuator drive, for example. It is also possible to couple the driver 18 only once for all the filling elements jointly at a certain position on the orbit of the filling elements 1 so that it does not rotate with the rotor 3, for example, for example in the corner area of the rotary motion of the rotor 3 between the container outlet and container inlet and/or to couple the driver 18 or drivers 18 so that they are driven by a manually operated actuator element for the movement of the rinsing plates 16 between the initial position and the rinsing position.

Each rinsing plate 16 has, on its radially inward side with reference to the vertical machine axis, a driver dog 19 that is fastened with one end to the rinsing plate 16 and projects beyond the underside of the rinsing plate, which driver dog 19 extends into the driver 18, and specifically both when the container carrier 7 is lowered and when the container carrier 7 is in the raised position, so that there is a driving connection between the rinsing plate 16 and the driver 18 regardless of the position of the container carrier 7. In this realization, the driver or drivers 18 are located, with reference to the vertical machine axis, radially inside the circular orbit on which the filling elements 1 move when the rotor is rotating.

In FIG. 1, **16*a* is a rinsing plate that can be used on a filling machine which does not have the rinsing plates 16 and the actuator means (driver 18, driver dog 19 etc.) for said rinsing plates 16. The rinsing plate 16*a*, which in turn is provided for each filling element 1 of the filling machine, is inserted for the preparation of the cleaning or rinsing phase when each container carrier 7 is lowered with its long sides into the grooves 17 of said container carrier, so that the seal 16*a*.1 is below the housing projection 2.1 or the open end of the recess 15, and then by raising the container carrier 7, the rinsing plate 16*a* can in turn be brought with its seal 16*a*.1 into the sealed position with the edge 2.1.1 After the rinsing or cleaning, each rinsing plate 16*a* is again removed after the container carrier 7** has been lowered.

One thing that all the exemplary embodiments described above have in common is that the movement of the rinsing plates 16 between the initial position and the rinsing position or the insertion and removal of the rinsing plates **16*a* takes place at the point where the container carriers 7 are lowered by the at least one control cam 11, i.e. at the container inlet or container outlet, and/or in the corner area between the container outlet and the container inlet. In particular when the rinsing plates 16***a* are inserted manually, the rotor 3 of the filling machine can be driven for this purpose at a low speed of rotation and/or in timed cycles.

This realization of the embodiments has the advantage that for the initiation and termination of the cleaning or rinsing phase, basically no additional modifications and/or adjustments to the filling machine are necessary, in particular no adjustments of the at least one control cam 11 or additional guide or control elements. Basically, however, other methods for the initiation and termination of the cleaning or rinsing phase are also conceivable.

As shown in the figures, when a container 6 is in the sealed position with the filling element 1, for example the seal 16.1 is located at a greater radial distance in the direction of the axis FA from the edge 2.1.1 than the underside of the O-ring 12 which is pressed against the container mouth 6.1. The stroke or travel or distance by which the container carrier 7 must be moved downward out of its position illustrated in FIG. 1 for the pick-up or release of a container 6 by the control cam can therefore be less than the distance that is required to lower the rinsing plate 16 as far as is necessary for its movement between the initial position and the rinsing position.

It thereby becomes possible, in addition to the at least one control cam 11 which controls the movement of the container carrier 7 during the normal filling process, to provide a control cam 11.1 which also interacts with the control rollers 10 of the filler elements and is moved downward and by means of which the container carrier 7 is moved farther downward than by the control cam 11 only during the preparation and termination of the cleaning and rinsing phase. The control cam 11 is then deactivated during the cleaning and rinsing phase, so that during the cleaning and rinsing phase, in spite of the rollers 10 that interact with the control cam 11, in each rotational position of the rotor 3 the seals 16.1 or 16*a*.1 of all the rinsing plates 16 and 16*a* respectively are pressed far enough against the respective edge 2.1.1 by the compression springs 13 to create closed rinsing spaces.

Figure 4:
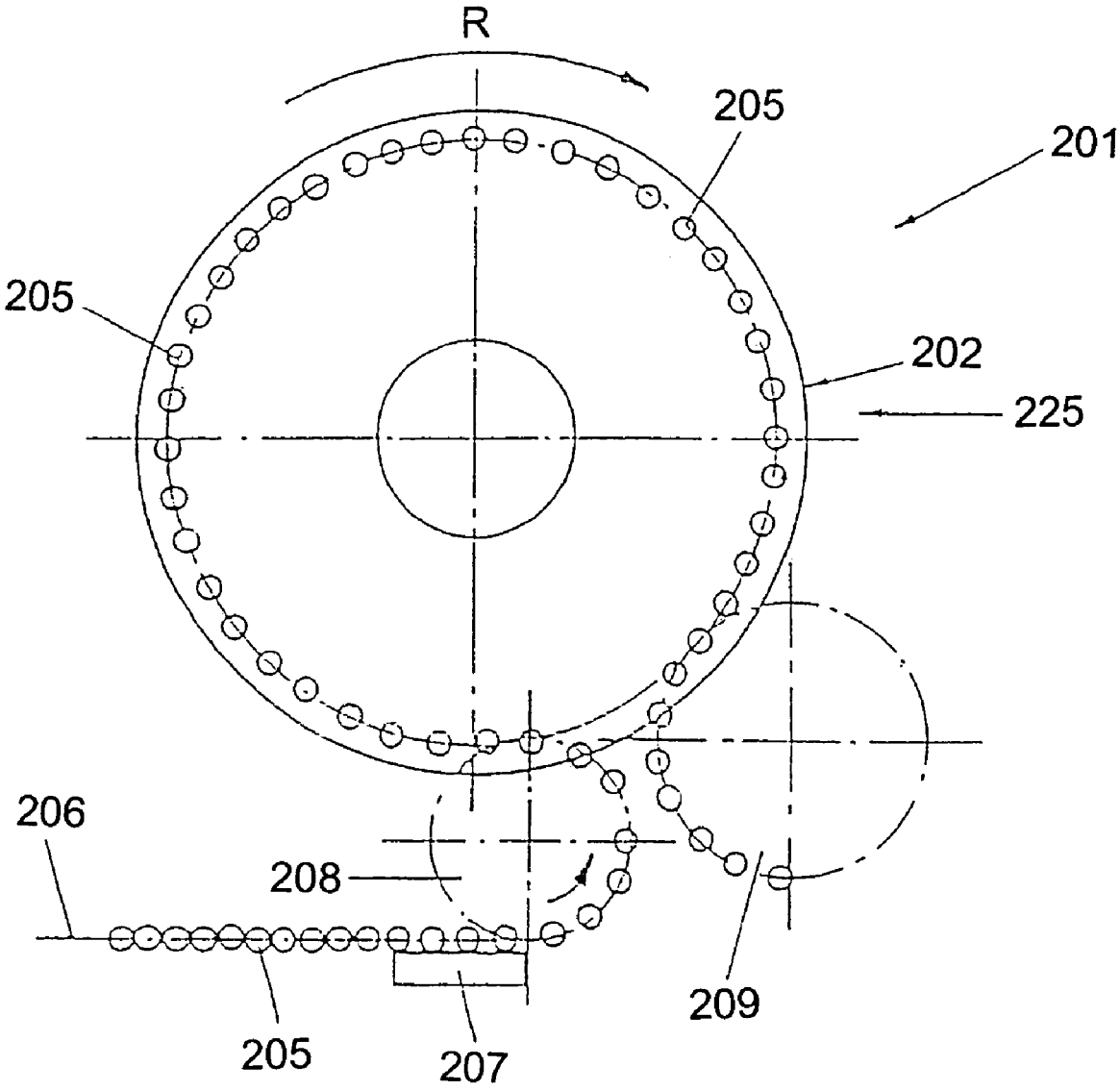
FIG. 4 is a schematic plan view of a filling machine with a rotating construction for filling a liquid substance into bottles according to at least one possible embodiment.
Figure 5:
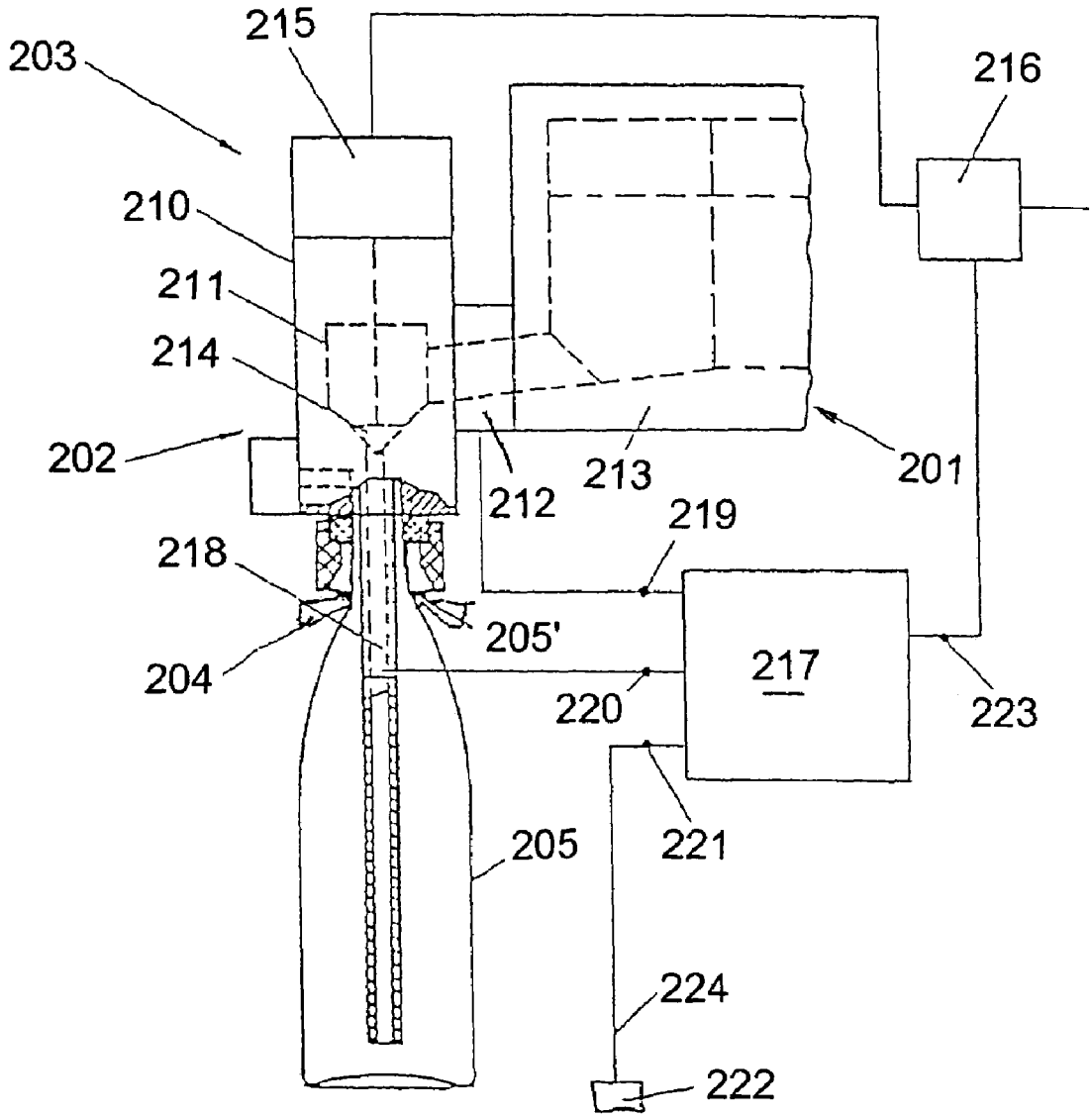
FIG. 5 is a simplified view with a block diagram and flow diagram of one of the filling elements of the filling machine illustrated in FIG. 4, together with a corresponding control system according to at least one possible embodiment.

The following paragraphs relating to FIGS. 4, 5, 6, 7, 8, 7A, and 8A described filling machine and components thereof which may possibly be used in or in conjunction with at least one possible embodiment of the application and components thereof. The filling machine illustrated in FIG. 4 is a bottling machine for counterpressure filling, for example for the bottling of soft drinks, beer, mineral water etc., and comprises a rotor 201 that rotates around a vertical machine axis in the direction of the arrow R, and on the periphery of the rotor 201 a number of filling positions 202 are formed which in the exemplary embodiment illustrated in FIG. 5 each comprise a filling element and a bottle carrier 204 that can be moved up and down by a lifting device. FIG. 4 shows all the filling positions between a bottle inlet and a bottle outlet of the filling machine, each of which is occupied by a plastic bottle (PET bottle).

The bottles 205 to be filled are fed to the filling machine via a conveyor 206, by means of a spacing screw 207 or are otherwise placed at the required spacing and transferred by means of an inlet star wheel 208 each to a filling position of the rotor 201. The filled bottles 205 are removed from the filling positions on an outlet star wheel 209 and transported to a capper, for example, which is not shown in the drawing.

Each filling element has, in the conventional manner, among other things, in a housing 210 of this filling element, a liquid duct 211, which is in communication with its one end via a volume flow meter 212 or otherwise with a ring bowl 213 for the liquid being bottled that forms a portion of the rotor 201.

With its other end, the liquid duct 211 forms a discharge opening provided on the underside of the housing 210, via which the liquid being bottled then flows to the respective bottle 205 when the liquid valve 214, which is also provided in the liquid channel 211, is opened.

Each filling element 203 also has an actuator device 215 to control the liquid valve 214 or to control a valve body of this liquid valve. The actuator element 215 is preferably a pneumatic actuator element which is actuated by a control device 217 by means of an electromagnetic control valve 216. Each filling element 203 also has, for example, a probe 218 that determines the fill level, which is realized for example in the form of a conductance probe, whereby the probe 218 is immersed in the liquid being bottled and supplies a probe signal when, during the filling of a bottle 205, the level of the liquid being bottled reaches a specified level in the bottle 205 that is provided at the filling element 203 or pressed against it. In the illustrated exemplary embodiment, the electronic control device 217, which is preferably a microprocessor-assisted device, has a total of three inputs 219, 220 and 221, of which the input 219 is connected to the signal output of the flow meter 212, the input 220 is connected to the probe 218 and the input 221 is connected to a common higher-level electronic control system (higher-level processor) for all the filling positions of the filling machine, as are the control devices 217 of the other filling positions 202 or filling elements 203. The control device 217 of each filling element 203 also has an output 223, by means of which the individual control valve 216 associated with each filling element 203 is actuated.

The operation of the filling machine and of each filling position 202 can be described as follows: After the respective bottle 205 has been transferred from the inlet star 208 to a filling position 202, in a specified angular range of the rotational movement of the rotor 201, after a pre-pressurization of the bottle 205 with its mouth 205' tight against the respective filling element 203, in the filling phase under counterpressure, first there is a volume filling of the bottle 205 with the liquid being bottled, i.e. the liquid valve 204 is opened to begin this filling phase. The volume filling is then ended by closing the liquid valve 214 when a specified volume of the liquid being bottled has been dispensed into the bottle provided at the respective filling position 202.

The volume filling is controlled on the basis of the quantity signal supplied by the flow meter 212. This signal consists, for example, of a pulse sequence, in which the number of pulses per unit of time is a yardstick for the flow or volume of the liquid being bottled that has flowed through the flow meter 212 in the unit of time in question. When the desired filling volume is reached, the control device 217 actuates the control valve 216 so that the liquid valve 214 is closed by means of the actuator element 215.

By means of the central control unit 222, the setpoint value for all the filling positions 202 and their control devices 217 can be input all at the sale time, namely by means of the signal line 224.

After the filling has been completed, and still under counterpressure with its mouth 205' still pressed tight against the filling element 203, the bottle 205 can be filled to the exact level desired by means of the probe, which ensures that the level of the liquid being bottled in the bottles 205 is uniform. Otherwise the next phase is the conventional depressurization of the respective bottle 205.

The container handling machine described above in the form of a filling machine can be realized and operated in a variety of different realizations, and its construction can be modified in any solutions that can be derived from the prior art.

Figure 6:
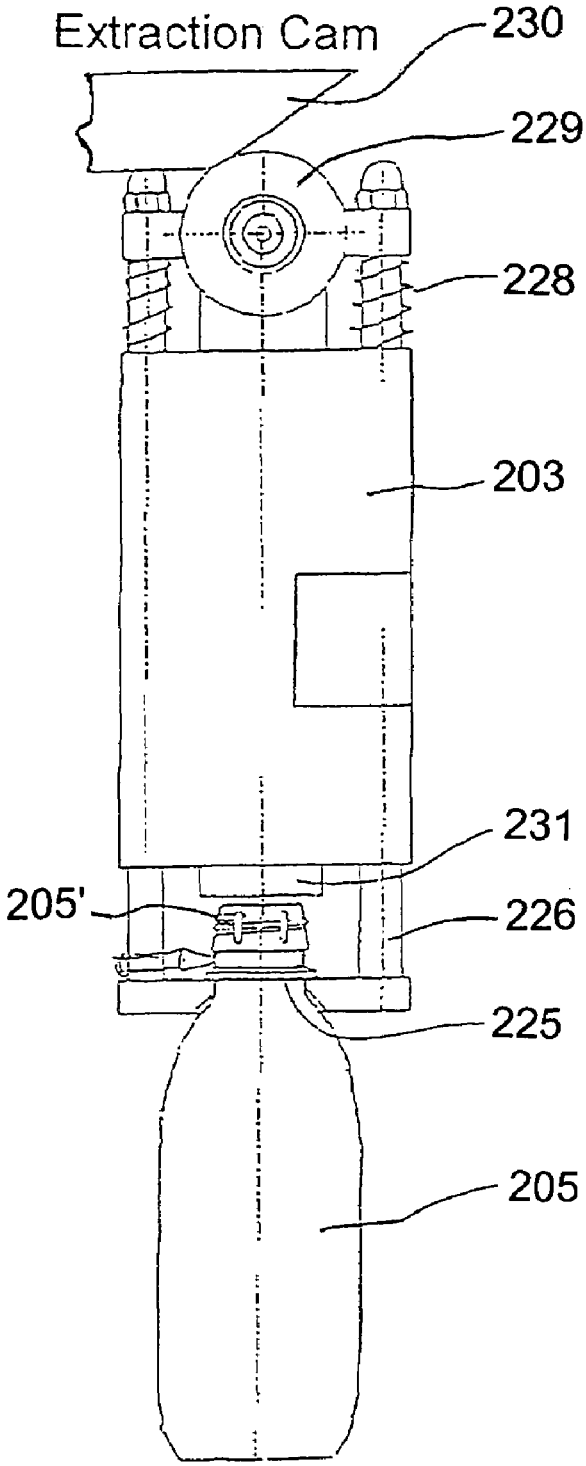
FIG. 6 shows the lifting device claimed by the invention on a handling head in the form of a filler element with a raised bottle according to at least one possible embodiment.
Figure 7:
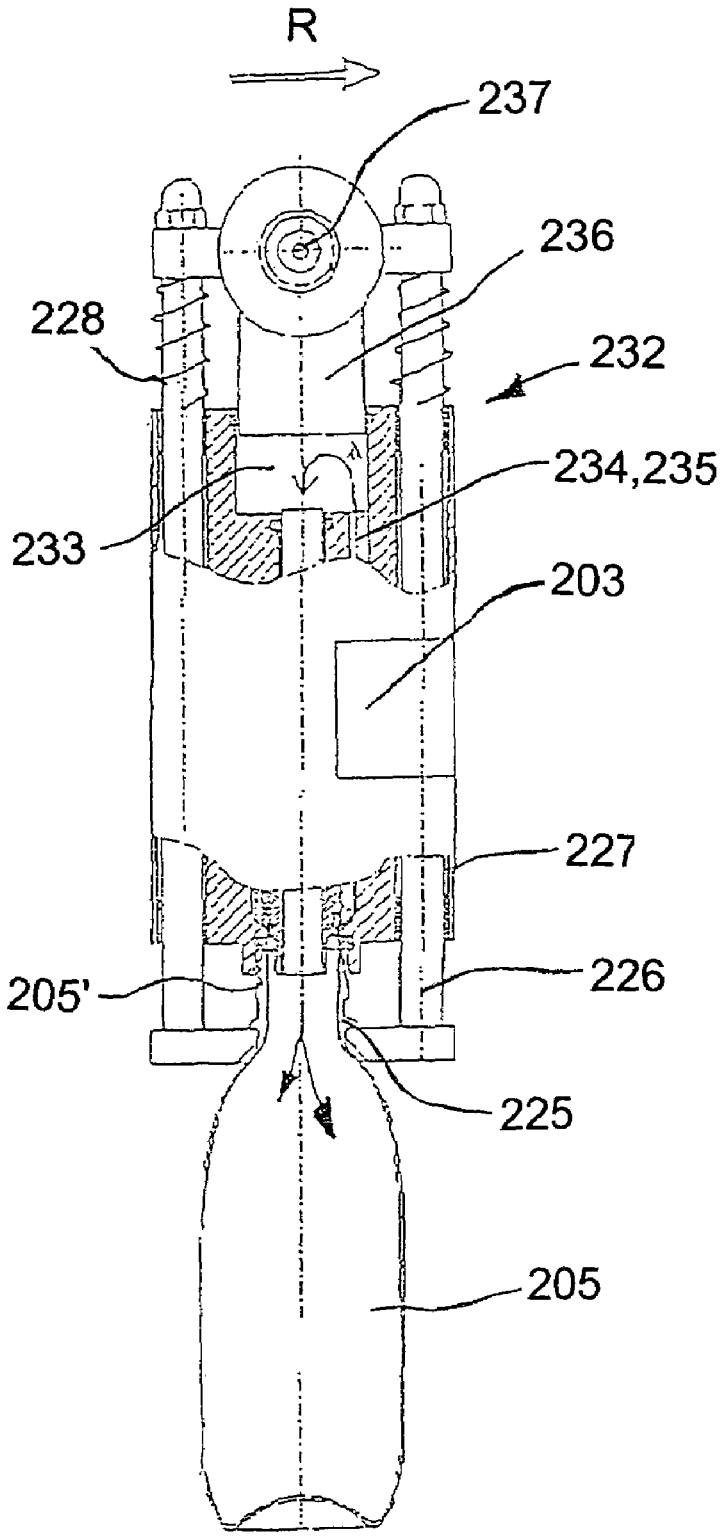
FIGS. 7 and 8 show the lifting device on a filling valve as illustrated in FIG. 6 in the counterpressure and filling phase according to at least one possible embodiment.
Figure 8:
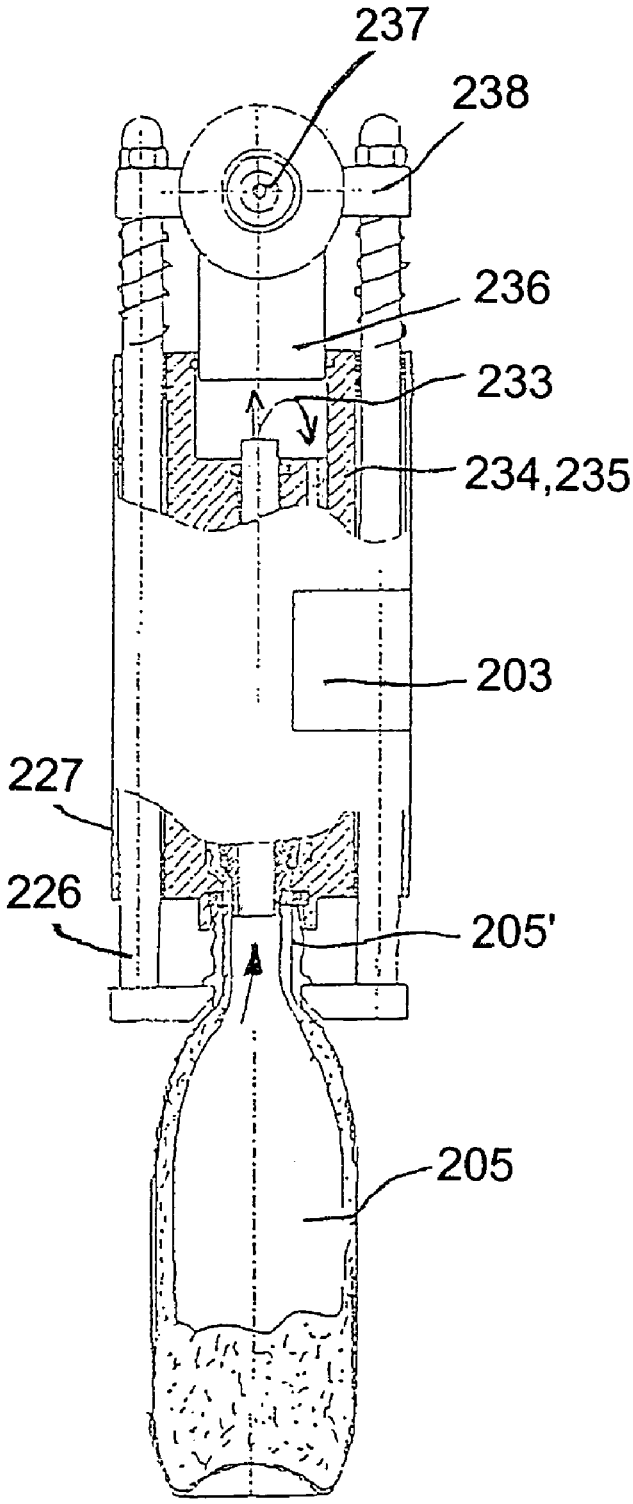

In the exemplary embodiment illustrated in FIGS. 6, 7 and 8, the holding devices are realized in the form of centering surfaces that support the neck collar 225 of a bottle 205 and are fastened to vertically movable lifting rods 226. The lifting rods 226 are held in guides 227 of the filling element 203 and are pressed by means of compression springs 228 with a guide roller 229 against a control cam 230, which causes a downward movement of the lifting elements by means of the guide roller 229 with which it is in contact. In this lower position, as shown in FIG. 6, for example, the bottles 205 are transferred to the centering surfaces. After taking over a supported bottle 205 and leaving the vicinity of the control cam, the bottles travel toward the discharge opening 231 of the filling element 203 and are pressed against the filling element only by the application force of the springs 228. The actual main pressing then begins when the filling process begins. For this purpose, as in the exemplary embodiment illustrated in FIGS. 6, 7 and 8, there is a piston/cylinder arrangement 232 above the discharge opening 231 on the filling valve body. As illustrated, the cylinder chamber 233 is appropriately realized in the form of the filling valve 203 and in the form of a pressure or entrance duct 234, 235 so that the fed bottles 205 can be filled and/or the pressure media in them can be discharged, e.g. flushing gas, counterpressure gas and pressurization gas, inert gas, sterilization media etc. The piston 236 is connected with the lifting roller bearing system 237 or its support 238 and is movable relative to the filling elements 203 fastened to the rotor 201. The optimum pressure of the bottle mouth 205' against the discharge channel or the dispensing openings is always ensured by the automatic pressurization of the cylinder chamber 233 with the compressed gas or similar gas used in the respective process. The piston 236 can also be realized in the form of an appropriately constructed membrane.

Figure 7A:
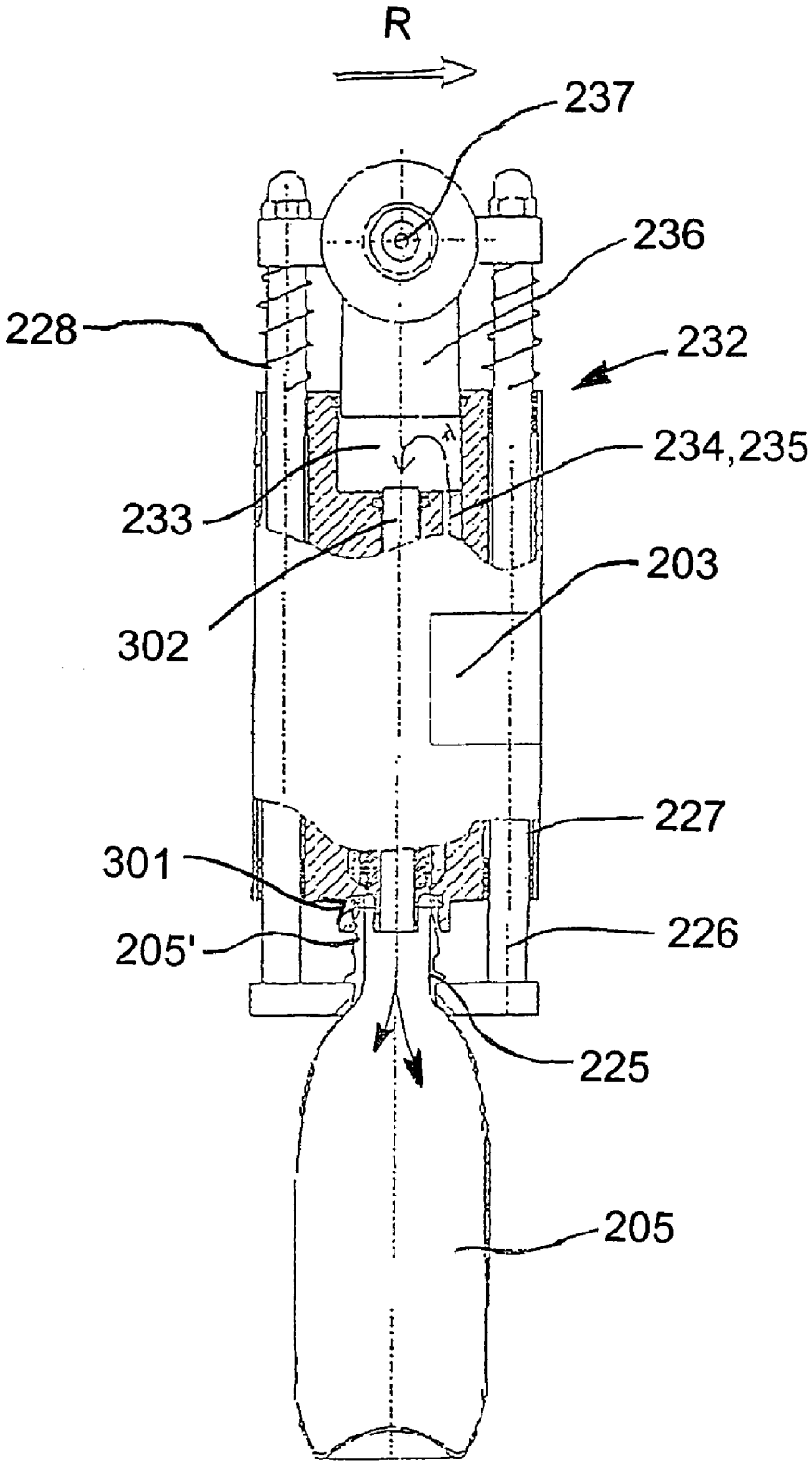
FIGS. 7A and 8A show the views shown in FIGS. 7 and 8 with additional numbering according to at least one possible embodiment.
Figure 8A:
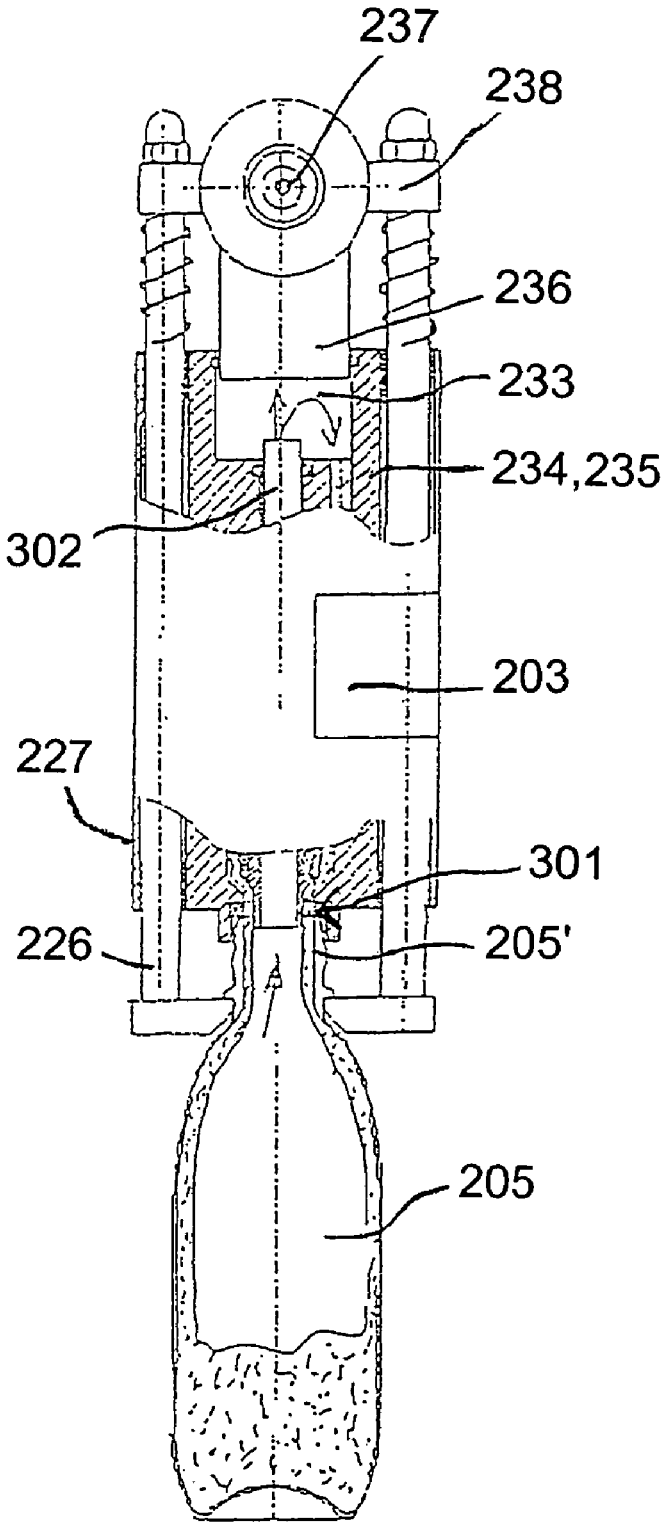

FIGS. 7A and 8A show the views shown in FIGS. 7 and 8 with additional numbering.

To further explain, in a filling process according to one possible embodiment, the bottle holding and filling device, such as shown in FIGS. 6, 7, and 8, has the guide roller 229 that is positioned and designed to come in contact with the cam structure 230. When the guide roller 229 comes in contact with the cam structure 230, the guide roller 229 and the lifting roller bearing system 237 are displaced downward in a vertical movement. Substantially simultaneously, the lifting rods 226, which are connected to the lifting roller bearing system 237 by the support arms 238, also are moved or displaced in a downward vertical movement within their corresponding guides 227, which are located in the filling element structure 203. The filling element structure 203 is mounted on a rotary filling machine carousel (see FIGS. 4 and 5) and does not move vertically. Consequently, the lifting rods 226 are moved vertically downward with respect to the filling element structure 203.

By moving the lifting rods 226 downward, the bottle carrier or holding structure 204 (see FIG. 5), which is connected to the lifting rods 226, is also substantially simultaneously moved downward with respect to the filling element structure 203. In this manner, the space between the bottle carrier 204 and the filling element structure 203 is increased such that the mouth 205' of the bottle 205 can be inserted into the space. The bottle 205 is held by its bottle neck by the bottle carrier 204 and is now ready to be filled with a beverage.

In the next step, the filling machine carousel rotates and the guide roller 229 is taken out of engagement with the cam structure 230. At this point the spring elements 228 are released from the pressure exerted on them by the downward movement of the guide roller structure 229 and lifting rods 226. The spring elements 228 cause the lifting rods 226 to move upward by exerting force against the top of the vertically stationary filling element structure 203 and the support arms 238. In this manner, the lifting rods 226, and substantially simultaneously the bottle carrier 204, are moved or displaced vertically upward with respect to the filling element structure 203. As a result, the mouth 205' of the bottle 205 is brought into a sealing engagement with the discharge opening 231.

The mouth 205' is now engaged with the discharge opening 231 and held in place there by the force of the springs 228. This is advantageous because a seal is established between the mouth 205' and a gasket structure 301 (see FIGS. 7A and 8A) of the discharge opening 231 without using excessive pressure as discussed above with respect to the prior art. Since the force of the springs 228 is not excessive in comparison to the force exerted by other known pressing devices, such as separate compression piston devices, the life of the gasket structure 301 will be extended since wear and tear produced by excessive pressure may be substantially reduced or essentially eliminated.

After this initial seal is established between the bottle mouth 205' and the gasket structure 301 of the discharge opening 231, pressure media, such as flushing gas, counterpressure gas and pressurization gas, inert gas, sterilization media, etc., can be introduced into the interior of the bottle 205. The pressure media can be transported into the bottle 205 through a cylinder structure 233. The cylinder structure 233 can have a pressure or entrance duct 234, 235 that permits flow of pressure media into and out of the bottle and cylinder structure 233.

In the embodiment shown in FIGS. 6, 7, and 8, the pressure media flows out of the entrance duct 234, 235 and enters the interior space of the cylinder structure 233 and contacts the piston 236. When the pressure media enters the cylinder structure 233 and contacts the piston 236, a force is exerted on the piston 236 by the initial pressure wave caused by the entrance of the pressure media. The force on the piston 236 is transferred to the lifting roller bearing system 237, which is connected to the piston 236. As a result, an upward-lifting force is exerted on the bottled carrier 204 connected to the roller bearing system 237 by the guide rods 226. This upward-lifting force causes the seal between the gasket structure 301 and the bottle mouth 205' to be tightened to promote an optimum seal. The tightened seal minimizes leakage of pressure media or beverage material during the filling process.

The pressure media substantially simultaneously then travels through a central passage or opening 302 (see FIGS. 7A and 8A) in the cylinder 233 into the bottle 205 to pressurize the interior of the bottle 205 in addition to promoting an optimal seal at the bottle mouth 205'. By maintaining pressure in this manner, foaming of the beverage material during filling can be substantially reduced, which thereby results in increased accuracy in the filling process with respect to the amount of beverage material to be filled into the bottle.

As shown in FIG. 8, the pressure media can then be discharged from the cylinder 233 via the entrance duct 234, 235, such as during filling of the bottle with beverage material. This is advantageous because the pressure media will first exit the bottle 205 as it is pushed out by the inflow of beverage material, thereby maintaining both a substantially constant force on the piston 236 and the tightened seal between the gasket structure 301 and the bottle mouth 205'. In this manner, pressure is maintained in the bottle 205 to prevent foaming, the tightened seal is maintained at the bottle mouth 205' to prevent leakage, and the overpressure or excessive pressure that can shorten the life span of the gasket structure 301 and other similar structures is minimized or essentially eliminated.

In at least one other possible embodiment, the cylinder structure 233 could be designed such that the pressure media travels from the entrance duct 234, 235 directly into the central passage 302 via a connecting passage located in the cylinder structure 233 other than the cylinder chamber below the piston 236. Such a connecting passage would permit the pressure media to flow into the central passage 302, and then substantially simultaneously to both the cylinder chamber and the bottle 205, as well as back out again through the connecting passage as necessary.

The above-described structures can be modified to be used in similar container-handling applications for containers, such as bottles and cans, of various shapes and sizes, and for various types of beverages. The cylinder can be configured to handle different pressure levels as necessary for different types of bottles and beverages. For example, the size and position of the passages, ducts, and channels in the cylinder can be modified to control factors related to the filling process, such as the pressure level, flow rate, and direction of travel of the pressure media. These modifications could be tested by experimentation to achieve a desired pressure for a particular filling process.

The embodiments are described herein on the basis of exemplary embodiments. It goes without saying that numerous modifications and variations are possible without thereby going beyond the scope of the teachings on which the present application is based.

One feature or aspect of an embodiment is believed at the time of the filing of this patent application to possibly reside broadly in a filling element of a filling machine, in particular a filling machine with a rotary construction for the filling of bottles or similar containers with a liquid, with a liquid duct realized in the form of a filling element housing for the controlled dispensing of the liquid via a dispensing opening on an underside of the filling element housing into a container that is placed against the filling element with a container carrier that can be moved in a controlled manner in the direction of a filling element axis, and that grasps the respective container on a stop or contact or carrier surface on the container for filling with its container mouth against a stop that is formed in a recess on the filling element, with at least one additional duct that empties into the recess or into the container pressed against the filling element, characterized by the fact that in or on the container carrier there is a closing element to close the recess to create a rinsing space that is closed toward the outside during a cleaning or rinsing of the filling element.

Another feature or aspect of an embodiment is believed at the time of the filing of this patent application to possibly reside broadly in a filling element, characterized by the fact that the closing element located on the container carrier can be pressed by the container carrier against a sealing surface that surrounds the opening of the recess.

Yet another feature or aspect of an embodiment is believed at the time of the filing of this patent application to possibly reside broadly in a filling element, characterized by the fact that the closing element is realized flat on its side that is pressed against the sealing surface.

Still another feature or aspect of an embodiment is believed at the time of the filing of this patent application to possibly reside broadly in a filling element, characterized by the fact that the surface of the closing element that is pressed against the sealing surface is formed by a seal that is located on the closing element.

A further feature or aspect of an embodiment is believed at the time of the filing of this patent application to possibly reside broadly in a filling element, characterized by the fact that the closing element is realized in the shape of a plate at least in a partial area that interacts with the sealing surface.

Another feature or aspect of an embodiment is believed at the time of the filing of this patent application to possibly reside broadly in a filling element, characterized by the fact that the closing element is a rinsing plate.

Yet another feature or aspect of an embodiment is believed at the time of the filing of this patent application to possibly reside broadly in a filling element, characterized by the fact that the container carrier is realized in the shape of a fork, for example, so that it can grasp and hold the respective container on a container flange that is formed on the container below the container mouth.

Still another feature or aspect of an embodiment is believed at the time of the filing of this patent application to possibly reside broadly in a filling element, characterized by the fact that at least one receptacle or guide is provided on the container carrier for the positioning of the closing element below the opening of the recess.

A further feature or aspect of an embodiment is believed at the time of the filing of this patent application to possibly reside broadly in a filling element, characterized by the fact that the closing element can be positioned in a rinsing position by introduction or movement radial to the filling element axis below the opening of the recess.

Another feature or aspect of an embodiment is believed at the time of the filing of this patent application to possibly reside broadly in a filling element, characterized by the fact that the closing element can be moved into or positioned in the rinsing position manually.

Yet another feature or aspect of an embodiment is believed at the time of the filing of this patent application to possibly reside broadly in a filling element, characterized by the fact that the closing element is provided on the filling element or on the container carrier so that it can be moved between an idle or initial position outside a space occupied by the respective container during filling and the rinsing position.

Still another feature or aspect of an embodiment is believed at the time of the filing of this patent application to possibly reside broadly in a filling element, characterized by the fact that the closing element can be moved in a guide of the container carrier between the initial position and the rinsing position radially or approximately radially with respect to the filling element axis.

A further feature or aspect of an embodiment is believed at the time of the filing of this patent application to possibly reside broadly in a filling element, characterized by the fact that the closing element is connected with an actuator mechanism for the movement between the rest position and the rinsing position.

Another feature or aspect of an embodiment is believed at the time of the filing of this patent application to possibly reside broadly in a filling element, characterized by the fact that the recess that holds the container during the filling with its container mouth is realized in the filling element housing or in a projection of a filling element housing.

Yet another feature or aspect of an embodiment is believed at the time of the filing of this patent application to possibly reside broadly in a filling element, characterized by the fact that the recess is formed by a centering element on the filling element housing or by a centering groove.

Still another feature or aspect of an embodiment is believed at the time of the filing of this patent application to possibly reside broadly in a filling element, characterized by the fact that the receptacle or guide for the closing element is located on the container carrier above a stop or contact or driver surface for the container.

A further feature or aspect of an embodiment is believed at the time of the filing of this patent application to possibly reside broadly in a filling element, characterized by its realization in the form of a filling element without a filler pipe.

Another feature or aspect of an embodiment is believed at the time of the filing of this patent application to possibly reside broadly in a filling element, characterized by the fact that the additional duct is a return gas duct formed by a return gas pipe, for example.

Yet another feature or aspect of an embodiment is believed at the time of the filing of this patent application to possibly reside broadly in a filling element, characterized by its realization in the form of a filling element with a short filling pipe.

Still another feature or aspect of an embodiment is believed at the time of the filing of this patent application to possibly reside broadly in a filling machine with a rotary construction for filling bottles or similar containers with a liquid, with a plurality of filling elements on a rotor, characterized by the fact that the filler elements are realized as recited in one of the preceding claims.

Another feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotatable carousel being configured and disposed to be rotated about a central, vertical axis of rotation; said beverage filling machine comprising a plurality of beverage filling devices for filling beverage bottles with liquid beverage material; said beverage filling devices being disposed on the periphery of said rotatable carousel; each of said beverage filling devices comprising: a dispensing arrangement being configured and disposed to control the dispensation of liquid beverage material into a beverage bottle; a liquid duct being configured and disposed to permit the flow of liquid beverage material into a beverage bottle upon filling, and being configured and disposed to permit the outflow of cleaning fluid upon cleaning of said beverage filling device; at least one additional duct being configured and disposed to permit the flow of gas out of a beverage bottle upon filling, and being configured and disposed to permit the inflow of cleaning fluid upon cleaning of said beverage filling device; a discharge opening being configured and disposed to be brought into sealing engagement with a mouth of a beverage bottle upon filling of the beverage bottle with liquid beverage material; a housing being configured and disposed to house said dispensing arrangement, said liquid duct, and said at least one additional duct; said housing comprising a projecting portion which projects beyond and encloses said discharge opening, said projecting portion comprising a perimeter edge disposed about the end of said projecting portion; said housing projecting portion forms a recess being configured and disposed to receive and enclose at least a portion of a mouth of a beverage bottle; a lifting device being configured and disposed to lift a mouth of a beverage bottle into sealing engagement with said discharge opening; said lifting device comprising: a support and centering structure to hold a neck of a beverage bottle; lifting rods being connected to said support and centering structure and being configured to be moved vertically to permit vertical movement of said support and centering structure; and a closing element being configured to be moved and to be brought into sealing engagement with said perimeter edge of said housing projection portion to close said recess to create a rinsing space that is closed toward the outside environment to permit cleaning of the interior of said beverage filling device and essentially prevent leakage of cleaning fluid upon cleaning.

Still another feature or aspect of an embodiment is believed at the time of the filing of this patent application to possibly reside broadly in a method of operating a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotatable carousel being configured and disposed to be rotated about a central, vertical axis of rotation; said beverage filling machine comprising a plurality of beverage filling devices for filling beverage bottles with liquid beverage material; said beverage filling devices being disposed on the periphery of said rotatable carousel; each of said beverage filling devices comprising: a dispensing arrangement being configured and disposed to control the dispensation of liquid beverage material into a beverage bottle; a liquid duct being configured and disposed to permit the flow of liquid beverage material into a beverage bottle upon filling, and being configured and disposed to permit the outflow of cleaning fluid upon cleaning of said beverage filling device; at least one additional duct being configured and disposed to permit the flow of gas out of a beverage bottle upon filling, and being configured and disposed to permit the inflow of cleaning fluid upon cleaning of said beverage filling device; a discharge opening being configured and disposed to be brought into sealing engagement with a mouth of a beverage bottle upon filling of the beverage bottle with liquid beverage material; a housing being configured and disposed to house said dispensing arrangement, said liquid duct, and said at least one additional duct; said housing comprising a projecting portion which projects beyond and encloses said discharge opening, said projecting portion comprising a perimeter edge disposed about the end of said projecting portion; said housing projecting portion forms a recess being configured and disposed to receive and enclose at least a portion of a mouth of a beverage bottle; a lifting device being configured and disposed to lift a mouth of a beverage bottle into sealing engagement with said discharge opening; said lifting device comprising: a support and centering structure to hold a neck of a beverage bottle; lifting rods being connected to said support and centering structure and being configured to be moved vertically to permit vertical movement of said support and centering structure; and a closing element being configured to be moved and to be brought into sealing engagement with said perimeter edge of said housing projection portion to close said recess to create a rinsing space that is closed toward the outside environment to permit cleaning of the interior of said beverage filling device and essentially prevent leakage of cleaning fluid upon cleaning, said method comprising the steps of: supplying beverage bottles to said beverage bottle cleaning machine; cleaning beverage bottles; transporting beverage bottles to said beverage filling machine; filling beverage bottles with liquid beverage material; transporting filled beverage bottles to said beverage bottle closing machine; closing tops of filled beverage bottles; transporting filled beverage bottles to said beverage bottle labeling machine; attaching labels onto filled beverage bottles; transporting filled beverage bottles to said beverage bottle packing station; arranging filled beverage bottles into groups of beverage bottles; packing groups of beverage bottles; performing a cleaning operation for cleaning each of said filling devices, said cleaning operation comprising the steps of: moving said support and centering structure vertically downward; moving said closing element from an inactive position adjacent said housing projection portion to an active position below and aligned and centered with said housing projection portion; moving said support and centering structure vertically upward to bring said closing element into a sealing engagement with said edge of said housing projection portion to create said rinsing space within said housing projection portion; supplying cleaning fluid through said at least one additional duct to said rinsing space to clean said at least one additional duct and said discharge opening; transferring cleaning fluid through said liquid duct and said dispensing arrangement to clean said liquid duct and said dispensing arrangement; evacuating cleaning fluid out of said filling device; moving said support and centering structure vertically downward and disengaging said closing element from said edge of said housing projection portion; and moving said closing element back to its inactive position; and resuming filling beverage bottles with said beverage filling machine upon completion of said cleaning operation.

The components disclosed in the various publications, disclosed or incorporated by reference herein, may possibly be used in possible embodiments, as well as equivalents thereof.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The appended drawings in their entirety, including all dimensions, proportions and/or shapes in at least one embodiment of the invention, are accurate and are hereby included by reference into this specification.

Some examples of sensors that may possibly be utilized or possibly adapted for use in at least one possible embodiment of the present application may possibly be found in the following U.S. Patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and No. 5,425,402, entitled "Bottling system with mass filling and capping arrays."

All, or substantially all, of the components and methods of the various embodiments may be used with at least one embodiment or all of the embodiments, if more than one embodiment is described herein.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004. The above applications are hereby incorporated by reference as if set forth in their entirety herein.

All of the patents, patent applications and publications recited herein, and in the Declaration attached hereto, are hereby incorporated by reference as if set forth in their entirety herein.

Some examples of computer systems that may possibly be utilized or possibly adapted for use in at least one possible embodiment of the present application may possibly be found in the following U.S. Patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign and international patent publication applications, namely, Federal Republic of Germany Patent Application No. 103 59 779.4, filed on Dec. 19, 2003, having inventor Dieter-Rudolf Krulitsch, and DE-OS 103 59 779.4 and DE-PS 103 597 79.4, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Related U.S. application Ser. No. 10/952,706, filed on Sep. 29, 2004, having inventor Dieter-Rudolf KRULITSCH, is incorporated by reference as if set forth in its entirety herein.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Filling element
2 Housing
2.1 Housing projection
2.1.1 Edge of the housing projection
3 Rotor
4 Dispensing opening
5 Return gas pipe
5.1 Return gas duct
6 Container
6.1 Container mouth
6.2 Container flange
7 Container carrier
7.1 Carrier element of the container carrier
7.1.1 Web of the carrier element
7.1.2 Leg segment of the carrier element
7.2 Carrier plate
8 Guide rod
9 Yoke
10 Control roller
11 Control cam
11.1 Additional control cam
12 O-ring
13 Compression spring
14 Recess
15 Recess
16, **16*a*** Rinsing plate
16.1, **16*a*.1** Seal
17 Guide groove
18 Driver
19 Driver dog

The invention claimed is:

1. A method of operating a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotatable carousel being configured and disposed to be rotated about a central, vertical axis of rotation; said beverage filling machine comprising a plurality of beverage filling devices for filling beverage bottles with liquid beverage material; said beverage filling devices being disposed on the periphery of said rotatable carousel; each of said beverage filling devices comprising: a dispensing arrangement being configured and disposed to control the dispensation of liquid beverage material into a beverage bottle; a liquid duct being configured and disposed to permit the flow of liquid beverage material into a beverage bottle upon filling, and being configured and disposed to permit the outflow of cleaning fluid upon cleaning of said beverage filling device; at least one additional duct being configured and disposed to permit the flow of gas out of a beverage bottle upon filling, and being configured and disposed to permit the inflow of cleaning fluid upon cleaning of said beverage filling device; a discharge opening being configured and disposed to be brought into sealing engagement with a mouth of a beverage bottle upon filling of the beverage bottle with liquid beverage material; a housing being configured and disposed to house said dispensing arrangement, said liquid duct, and said at least one additional duct; said housing comprising a projecting portion which projects beyond and encloses said discharge opening, said projecting portion comprising a perimeter edge disposed about the end of said projecting portion; said housing projecting portion forms a recess being configured and disposed to receive and enclose at least a portion of a mouth of a beverage bottle; a lifting device being configured and disposed to lift a mouth of a beverage bottle into sealing engagement with said discharge opening; said lifting device comprising: a support and centering structure to hold a neck of a beverage bottle; lifting rods being connected to said support and centering structure and being configured to be moved vertically to permit vertical movement of said support and centering structure; and a closing element being configured to be moved and to be brought into sealing engagement with said perimeter edge of said housing projection portion to close said recess to create a rinsing space that is closed toward the outside environment to permit cleaning of the interior of said beverage filling device and essentially prevent leakage of cleaning fluid upon cleaning, said method comprising the steps of:

supplying beverage bottles to said beverage bottle cleaning machine;

cleaning beverage bottles;

transporting beverage bottles to said beverage filling machine;

filling beverage bottles with liquid beverage material;

transporting filled beverage bottles to said beverage bottle closing machine;

closing tops of filled beverage bottles;

transporting filled beverage bottles to said beverage bottle labeling machine;

attaching labels onto filled beverage bottles;

transporting filled beverage bottles to said beverage bottle packing station;

arranging filled beverage bottles into groups of beverage bottles;

packing groups of beverage bottles;

performing a cleaning operation for cleaning each of said filling devices, said cleaning operation comprising the steps of:

moving said support and centering structure vertically downward;

moving said closing element from an inactive position adjacent said housing projection portion to an active position below and aligned and centered with said housing projection portion;

moving said support and centering structure vertically upward to bring said closing element into a sealing engagement with said edge of said housing projection portion to create said rinsing space within said housing projection portion;

supplying cleaning fluid through said at least one additional duct to said rinsing space to clean said at least one additional duct and said discharge opening;

transferring cleaning fluid through said liquid duct and said dispensing arrangement to clean said liquid duct and said dispensing arrangement;

evacuating cleaning fluid out of said filling device;

moving said support and centering structure vertically downward and disengaging said closing element from said edge of said housing projection portion; and moving said closing element back to its inactive position; and resuming filling beverage bottles with said beverage filling machine upon completion of said cleaning operation.

2. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

said first conveyer arrangement comprising a star wheel structure;

a beverage bottle closing machine being configured and disposed to close tops of filled beverage bottles;

a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packing station being configured and disposed to package labeled, filled, closed beverage bottles;

a fourth conveyor arrangement being configured and disposed to move labeled, filled, closed beverage bottles from said beverage bottle labeling machine to said beverage bottle packing station;

said fourth conveyer arrangement comprising a linear conveyor structure being configured and disposed to arrange beverage bottles in groups for packing;

said beverage filling machine comprising a rotatable carousel being configured and disposed to be rotated about a central, vertical axis of rotation;

said beverage filling machine comprising a plurality of beverage filling devices for filling beverage bottles with liquid beverage material;

said beverage filling devices being disposed on the periphery of said rotatable carousel;

each of said beverage filling devices comprising:

a dispensing arrangement being configured and disposed to control the dispensation of liquid beverage material into a beverage bottle;

a liquid duct being configured and disposed to permit the flow of liquid beverage material into a beverage bottle upon filling, and being configured and disposed to permit the outflow of cleaning fluid upon cleaning of said beverage filling device;

at least one additional duct being configured and disposed to permit the flow of gas out of a beverage bottle upon filling, and being configured and disposed to permit the inflow of cleaning fluid upon cleaning of said beverage filling device;

a discharge opening being configured and disposed to be brought into sealing engagement with a mouth of a beverage bottle upon filling of the beverage bottle with liquid beverage material;

a housing being configured and disposed to house said dispensing arrangement, said liquid duct, and said at least one additional duct;

said housing comprising a projecting portion which projects beyond and encloses said discharge opening, said projecting portion comprising a perimeter edge disposed about the end of said projecting portion;

said housing projecting portion forms a recess being configured and disposed to receive and enclose at least a portion of a mouth of a beverage bottle;

a lifting device being configured and disposed to lift a mouth of a beverage bottle into sealing engagement with said discharge opening;

said lifting device comprising:

a support and centering structure to hold a neck of a beverage bottle;

lifting rods being connected to said support and centering structure and being configured to be moved vertically to permit vertical movement of said support and centering structure; and a closing element being configured to be moved and to be brought into sealing engagement with said perimeter edge of said housing projection portion to close said recess to create a rinsing space that is closed toward the outside environment to permit cleaning of the interior of said beverage filling device and essentially prevent leakage of cleaning fluid upon cleaning.

3. The beverage bottling plant according to claim 2, wherein each of said filling devices comprises a filling element (1), with a liquid duct realized in the form of a filling element housing (2) for the controlled dispensing of the liquid via a dispensing opening (4) on an underside of the filling element housing (2) into a container (6) that is placed against the filling element (1) with a container carrier (7) that can be moved in a controlled manner in the direction of a filling element axis (FA), and that grasps the respective container (6) on a stop or contact or carrier surface (6.2) on the container for filling with its container mouth (6.1) against a stop (12) that is formed in a recess (15) on the filling element, with at least one additional duct (5.1) that empties into the recess (15) or into the container pressed against the filling element (1), characterized by the fact that in or on the container carrier (7) there is a closing element (16, 16*a*) to close the recess (15) to create a rinsing space that is closed toward the outside during a cleaning or rinsing of the filling element (1).

4. The beverage bottling plant according to claim 3, wherein one of:

the closing element (16, 16*a*) located on the container carrier (7) can be pressed by the container carrier (7) against a sealing surface (2.1.1) that surrounds the opening of the recess (15); and the closing element (16, 16*a*) is realized flat on its side that is pressed against the sealing surface (2.1.1).

5. The beverage bottling plant according to claim 4, wherein: the surface of the closing element (16, 16*a*) that is pressed against the sealing surface (2.1.1) is formed by a seal (16.1, 16.*a*.1) that is located on the closing element (16, 16*a*);

the closing element (16, 16*a*) is realized in the shape of a plate at least in a partial area that interacts with the sealing surface (2.1.1);

the closing element is a rinsing plate (16, 16*a*);

the container carrier (7) is realized in the shape of a fork, so that it can grasp and hold the respective container (6) on a container flange (6.2) that is formed on the container below the container mouth (6.1);

at least one receptacle or guide (17) is provided on the container carrier (7) for the positioning of the closing element (16, 16*a*) below the opening of the recess (15);

the closing element (16, 16*a*) can be positioned in a rinsing position by introduction or movement radial to the filling element axis below the opening of the recess (15);

the closing element (16*a*) can be moved into or positioned in the rinsing position manually;

the closing element (16) is provided on the filling element (1) or on the container carrier (7) so that it can be moved between an idle or initial position outside a space occupied by the respective container (6) during filling and the rinsing position;

the closing element (16) can be moved in a guide (17) of the container carrier (7) between the initial position and the rinsing position radially or approximately radially with respect to the filling element axis (FA);

the closing element (16) is connected with an actuator mechanism (18, 19) for the movement between the rest position and the rinsing position;

the recess (15) that holds the container (6) during the filling with its container mouth (6.1) is realized in the filling element housing (2) or in a projection (2.1) of a filling element housing (2);

the recess (15) is formed by a centering element on the filling element housing or by a centering groove;

the receptacle or guide (17) for the closing element (16, 16*a*) is located on the container carrier (7) above a stop or contact or driver surface (7.2) for the container (6);

the additional duct is a return gas duct (5.1) formed by a return gas pipe (5); and the filling element comprises one of:

a filling element without a filler pipe; and a filling element with a short filling pipe.

6. A beverage filling device for use in a rotatable beverage filling machine to fill beverage bottles with a liquid beverage material, said beverage filling device comprising:

a dispensing arrangement being configured and disposed to control the dispensation of liquid beverage material into a beverage bottle;

a liquid duct being configured and disposed to permit the flow of liquid beverage material into a beverage bottle upon filling, and being configured and disposed to permit the outflow of cleaning fluid upon cleaning of said beverage filling device;

at least one additional duct being configured and disposed to permit the flow of gas out of a beverage bottle upon filling, and being configured and disposed to permit the inflow of cleaning fluid upon cleaning of said beverage filling device;

a discharge opening being configured and disposed to be brought into sealing engagement with a mouth of a beverage bottle upon filling of the beverage bottle with liquid beverage material;

a housing being configured and disposed to house said dispensing arrangement, said liquid duct, and said at least one additional duct;

said housing comprising a projecting portion which projects beyond and encloses said discharge opening, said projecting portion comprising a perimeter edge disposed about the end of said projecting portion;

said housing projecting portion forms a recess being configured and disposed to receive and enclose at least a portion of a mouth of a beverage bottle;

a lifting device being configured and disposed to lift a mouth of a beverage bottle into sealing engagement with said discharge opening;

said lifting device comprising:

a support and centering structure to hold a neck of a beverage bottle;

lifting rods being connected to said support and centering structure and being configured to be moved vertically to permit vertical movement of said support and centering structure; and a closing element being configured to be moved and to be brought into sealing engagement with said perimeter edge of said housing projection portion to close said recess to create a rinsing space that is closed toward the outside environment to permit cleaning of the interior of said beverage filling device and essentially prevent leakage of cleaning fluid upon cleaning.

7. The beverage filling device according to claim 5, further comprising a filling element (1) duct realized in the form of a filling element housing (2) for the controlled dispensing of the liquid via a dispensing opening (4) on an underside of the filling element housing (2) into a container (6) that is placed against the filling element (1) with a container carrier (7) that can be moved in a controlled manner in the direction of a filling element axis (FA), and that grasps the respective container (6) on a stop or contact or carrier surface (6.2) on the container for filling with its container mouth (6.1) against a stop (12) that is formed in a recess (15) on the filling element, with at least one additional duct (5.1) that empties into the recess (15) or into the container pressed against the filling element (1), characterized by the fact that in or on the container carrier (7) there is a closing element (16, 16*a*) to close the recess (15) to create a rinsing space that is closed toward the outside during a cleaning or rinsing of the filling element (1).

8. The beverage filling device according to claim 7, characterized by the fact that the closing element (16, 16*a*) is realized flat on its side that is pressed against the sealing surface (2.1.1).

9. The beverage filling device according to claim 7, characterized by the fact that the closing element (16, 16*a*) located on the container carrier (7) can be pressed by the container carrier (7) against a sealing surface (2.1.1) that surrounds the opening of the recess (15).

10. The beverage filling device according to claim 9, characterized by the fact that the surface of the closing element (16, 16*a*) that is pressed against the sealing surface (2.1.1) is formed by a seal (16.1, 16.*a*.1) that is located on the closing element (16, 16*a*).

11. The beverage filling device according to claim 10, characterized by the fact that the closing element (16, 16*a*) is realized in the shape of a plate at least in a partial area that interacts with the sealing surface (2.1.1).

12. The beverage filling device according to claim 11, characterized by the fact that the closing element is a rinsing plate (16, 16*a*).

13. The beverage filling device according to claim 12, characterized by the fact that the container carrier (7) is realized in the shape of a fork, for example, so that it can grasp and hold the respective container (6) on a container flange (6.2) that is formed on the container below the container mouth (6.1).

14. The beverage filling device according to claim 13, characterized by the fact that the closing element (16, 16*a*)

can be positioned in a rinsing position by introduction or movement radial to the filling element axis below the opening of the recess (15).

15. The beverage filling device according to claim 13, characterized by the fact that at least one receptacle or guide (17) is provided on the container carrier (7) for the positioning of the closing element (16, 16*a*) below the opening of the recess (15).

16. The beverage filling device according to claim 15, characterized by the fact that the closing element (16*a*) can be moved into or positioned in the rinsing position manually.

17. The beverage filling device according to claim 16, characterized by the fact that the closing element (16) can be moved in a guide (17) of the container carrier (7) between the initial position and the rinsing position radially or approximately radially with respect to the filling element axis (FA).

18. The beverage filling device according to claim 16, characterized by the fact that the closing element (16) is provided on the filling element (1) or on the container carrier (7) so that it can be moved between an idle or initial position outside a space occupied by the respective container (6) during filling and the rinsing position.

19. The beverage filling device according to claim 18, wherein:

the closing element (16) is connected with an actuator mechanism (18, 19) for the movement between the rest position and the rinsing position;

the recess (15) that holds the container (6) during the filling with its container mouth (6.1) is realized in the filling element housing (2) or in a projection (2.1) of a filling element housing (2);

the recess (15) is formed by a centering element on the filling element housing or by a centering groove;

the receptacle or guide (17) for the closing element (16, 16*a*) is located on the container carrier (7) above a stop or contact or driver surface (7.2) for the container (6);

the additional duct is a return gas duct (5.1) formed by a return gas pipe (5); and the filling element comprises one of:

a filling element without a filler pipe; and a filling element with a short filling pipe.

* * * * *

UNITED STATES PATENT AND TRADEMARK OFFICE

CERTIFICATE OF CORRECTION

PATENT NO. : 7,104,033 B2
APPLICATION NO. : 11/016363
DATED : September 12, 2006
INVENTOR(S) : Dieter-Rudolf Krulitsch It is certified that error appears in the above-identified patent and that said Letters Patent is hereby corrected as shown below:

In column 28, line 20, Claim 7, after "claim", delete "5," and insert --6,--.

In column 28, line 21, Claim 7, after "(1)", insert --with a liquid--.

Signed and Sealed this

Twenty-sixth Day of June, 2007

JON W. DUDAS
*Director of the United States Patent and Trademark Office*